US006607425B1

(12) United States Patent
Kistler et al.

(10) Patent No.: US 6,607,425 B1
(45) Date of Patent: Aug. 19, 2003

(54) PRESSURIZED MEMBRANE PLATEN DESIGN FOR IMPROVING PERFORMANCE IN CMP APPLICATIONS

(75) Inventors: Rod Kistler, Los Gatos, CA (US); John Boyd, Atascadero, CA (US); Alek Owczarz, San Jose, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 09/747,845

(22) Filed: Dec. 21, 2000

(51) Int. Cl.[7] ..... B24B 1/00

(52) U.S. Cl. ..... 451/41; 451/173; 451/168; 451/303; 451/288

(58) Field of Search ..... 451/285–289, 451/41, 59, 495, 142, 494, 303, 168, 173

(56) References Cited

U.S. PATENT DOCUMENTS

| | | | | | |
|---|---|---|---|---|---|
| 4,084,356 | A | * | 4/1978 | Brears | 451/59 |
| 4,606,151 | A | * | 8/1986 | Heynacher | 451/42 |
| 4,628,640 | A | * | 12/1986 | Johannsen | 451/303 |
| 4,850,152 | A | * | 7/1989 | Heynacher et al. | 451/42 |
| 5,575,707 | A | * | 11/1996 | Talieh et al. | 451/173 |
| 5,584,751 | A | | 12/1996 | Kobayashi et al. | |
| 5,662,518 | A | * | 9/1997 | James et al. | 451/384 |
| 5,722,877 | A | | 3/1998 | Meyer et al. | |
| 5,762,546 | A | * | 6/1998 | James et al. | 451/504 |
| 5,800,248 | A | * | 9/1998 | Pant et al. | 451/41 |
| 5,888,120 | A | | 3/1999 | Doran | |
| 5,888,126 | A | | 3/1999 | Hirose et al. | |
| 5,916,012 | A | | 6/1999 | Pant et al. | |
| 5,931,719 | A | * | 8/1999 | Nagahara et al. | 451/41 |
| 5,961,372 | A | | 10/1999 | Shendon | |
| 5,980,368 | A | | 11/1999 | Chang et al. | |
| 6,062,959 | A | | 5/2000 | Weldon et al. | |
| 6,102,786 | A | | 8/2000 | Hirose et al. | |
| 6,103,628 | A | | 8/2000 | Talieh | |
| 6,126,527 | A | | 10/2000 | Kao et al. | |
| 6,135,858 | A | * | 10/2000 | Takahashi | 451/41 |
| 6,135,859 | A | | 10/2000 | Tietz | |
| 6,234,878 | B1 | | 5/2001 | Moore | |
| 6,267,659 | B1 | * | 7/2001 | Chen et al. | 451/533 |
| 6,273,800 | B1 | * | 8/2001 | Walker et al. | 451/168 |
| 6,325,706 | B1 | * | 12/2001 | Krusell et al. | 451/296 |
| 6,358,118 | B1 | * | 3/2002 | Boehm et al. | 451/24 |
| 6,361,411 | B1 | * | 3/2002 | Chopra et al. | 451/56 |
| 6,439,967 | B2 | * | 8/2002 | Carpenter | 451/41 |

FOREIGN PATENT DOCUMENTS

| | | |
|---|---|---|
| EP | 0881039 | 12/1998 |
| EP | 0920956 | 6/1999 |
| FR | 2767735 | 8/1998 |
| JP | 03259520 | 11/1991 |

* cited by examiner

*Primary Examiner*—George Nguyen
(74) *Attorney, Agent, or Firm*—Martine & Penilla, LLP

(57) ABSTRACT

An invention is disclosed for improved performance in a CMP process using a pressurized membrane as a replacement for a platen air bearing. In one embodiment, a platen for improving performance in CMP applications is disclosed. The platen includes a membrane disposed above the platen, and a plurality of annular bladders disposed below the membrane, wherein the annular bladders are capable of exerting force on the membrane. In this manner, zonal control is provided during the CMP process.

29 Claims, 10 Drawing Sheets

PRESSURIZED MEMBRANE PLATEN DESIGN FOR IMPROVING PERFORMANCE IN CMP APPLICATIONS

CROSS REFERENCE TO RELATED APPLICATIONS

This application is related to the following applications: (1) U.S. patent application Ser. No. 09/747,828, filed Dec. 21, 2000, and entitled "Platen Design for Improving Edge Performance in CMP Applications"; and (2) U.S. patent application Ser. No. 09/747,844, filed Dec. 21, 2000, and entitled "Piezoelectric Platen Design for Improving Performance in CMP Applications." Each of these related application is incorporated herein be reference.

BACKGROUND OF THE INVENTION

1. Field of the Invention

This invention relates generally to chemical mechanical polishing apparatuses, and more particularly to platen designs using pressurized membranes for improved performance in chemical mechanical polishing applications.

2. Description of the Related Art

In the fabrication of semiconductor devices, there is a need to perform Chemical Mechanical Polishing (CMP) operations, including polishing, buffing and wafer cleaning. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. Patterned conductive layers are insulated from other conductive layers by dielectric materials, such as silicon dioxide. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excess metallization.

In the prior art, CMP systems typically implement belt, orbital, or brush stations in which belts, pads, or brushes are used to scrub, buff, and polish one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1 illustrates an exemplary prior art CMP system 10. The CMP system 10 in FIG. 1 is a belt-type system, so designated because the preparation surface is an endless belt 18 mounted on two drums 24 which drive the belt 18 in a rotational motion as indicated by belt rotation directional arrows 26. A wafer 12 is mounted on a wafer head 14, which is rotated in direction 16. The rotating wafer 12 is then applied against the rotating belt 18 with a force F to accomplish a CMP process. Some CMP processes require significant force F to be applied. A platen 22 is provided to stabilize the belt 18 and to provide a solid surface onto which to apply the wafer 12. Slurry 28 composing of an aqueous solution such as $NH_4OH$ or DI containing dispersed abrasive particles is introduced upstream of the wafer 12. The process of scrubbing, buffing and polishing of the surface of the wafer is achieved by using an endless polishing pad glued to belt 18. Typically, the polishing pad is composed of porous or fibrous materials and lacks fix abrasives.

FIG. 2 is a detailed view of a conventional wafer head and platen configuration 30. The wafer head and platen configuration 30 includes the wafer head 14 and the platen 22 positioned below the wafer head 14. The wafer head 14 includes a fixed retaining ring 32 that holds the wafer 12 in position below the wafer head 14. Between the wafer head 14 and the platen 22 is the polishing pad and belt 18. The polishing platen 22 is closely spaced from a polishing pad or belt 18 with a very thin air space, referred to as an "air bearing", being defined between the platen 22 and the polishing pad 18. The air bearing between the platen 22 and the pad 18 has been conventionally used in an attempt to create a uniform polishing of the surface.

To maintain the air bearing, air source holes generally are formed in the platen 22 and are arranged in concentric ring patterns from the center of the platen 22 to the outer edge of the platen 22. Each ring establishes an air delivery zone where air from an air source is directed through the holes during polishing, thus establishing the air bearing. Air is exhausted past the platen edge.

With multiple air delivery zones, the air distribution profile of the air bearing can be varied radially as necessary to achieve optimal polishing by vary the polishing rate in each zone. Unfortunately, the distribution profiles of the zones are not completely independent of each other. This complicates establishing different distribution profiles for different zones.

Moreover, the air bearing is very sensitive to conditions. For example, the pressure of the air bearing varies with the gap between the pad 18 and the platen 22. Thus, if the pad 18 is pushed toward the platen 22 in one area, the pressure of all areas of the air bearing are affected, thus adding unwanted complexity to the CMP process.

In view of the foregoing, there is a need for a method that establishes greater independence of the air distribution profiles, zone to zone, thereby facilitating establishing a polishing rate in each zone independently of the other zones and, hence, improving manufacturing flexibility and functionality.

SUMMARY OF THE INVENTION

Broadly speaking, the present invention fills these needs by providing improved performance in a CMP process using a pressurized membrane as a replacement for a platen air bearing. In one embodiment, a platen for improving performance in CMP applications is disclosed. The platen includes a membrane disposed above the platen. Disposed below the membrane is a plurality of annular bladders capable of exerting force on the membrane. In this manner, zonal control is provided during the CMP process.

In another embodiment, a system for improving performance in CMP applications is disclosed. The system includes a wafer head capable of carrying a wafer, and a polishing belt positioned below the wafer head. Further included in the system is a platen having a membrane positioned below the polishing belt. The platen further includes annular bladders disposed below the membrane, which are capable of exerting force on the membrane.

A method for improving performance in CMP applications is disclosed in yet another embodiment of the present invention. Initially, a platen is provided having a membrane positioned above the platen. The platen further includes annular bladders disposed below the membrane, which are capable of exerting force on the membrane. A wafer is then applied to a polishing belt that is disposed above the platen. Further, the polishing belt is stabilized using the platen, where the membrane on the platen applies specific forces to the polishing belt utilizing the annular bladders.

Advantageously, the annular bladders of the embodiments of the present invention improve performance during a CMP process by providing increased zonal control to the pressurized membrane. Further, unlike a conventional air bearing, the pressurized membrane of the embodiments of the present invention greatly reduces the amount of air needed during the CMP process.

Moreover, a CMP process using the pressurized membrane of the present invention is not as sensitive to conditions as conventional CMP processes utilizing air bearings. Unlike air bearings, the pressure of the pressurized membrane of the present invention does not experience as great a variance as experienced by air bearings when the gap between the polishing pad and the platen varies. Thus, if the polishing pad is pushed toward the platen in one area, the pressure in other areas of the pressurized membrane are not as affected as other areas would be when utilizing an air bearing.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for improved performance in a CMP process using a pressurized membrane as a replacement for a platen air bearing. The present invention provides a pressurized membrane, which provides zonal control during the CMP process via concentric bladders. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
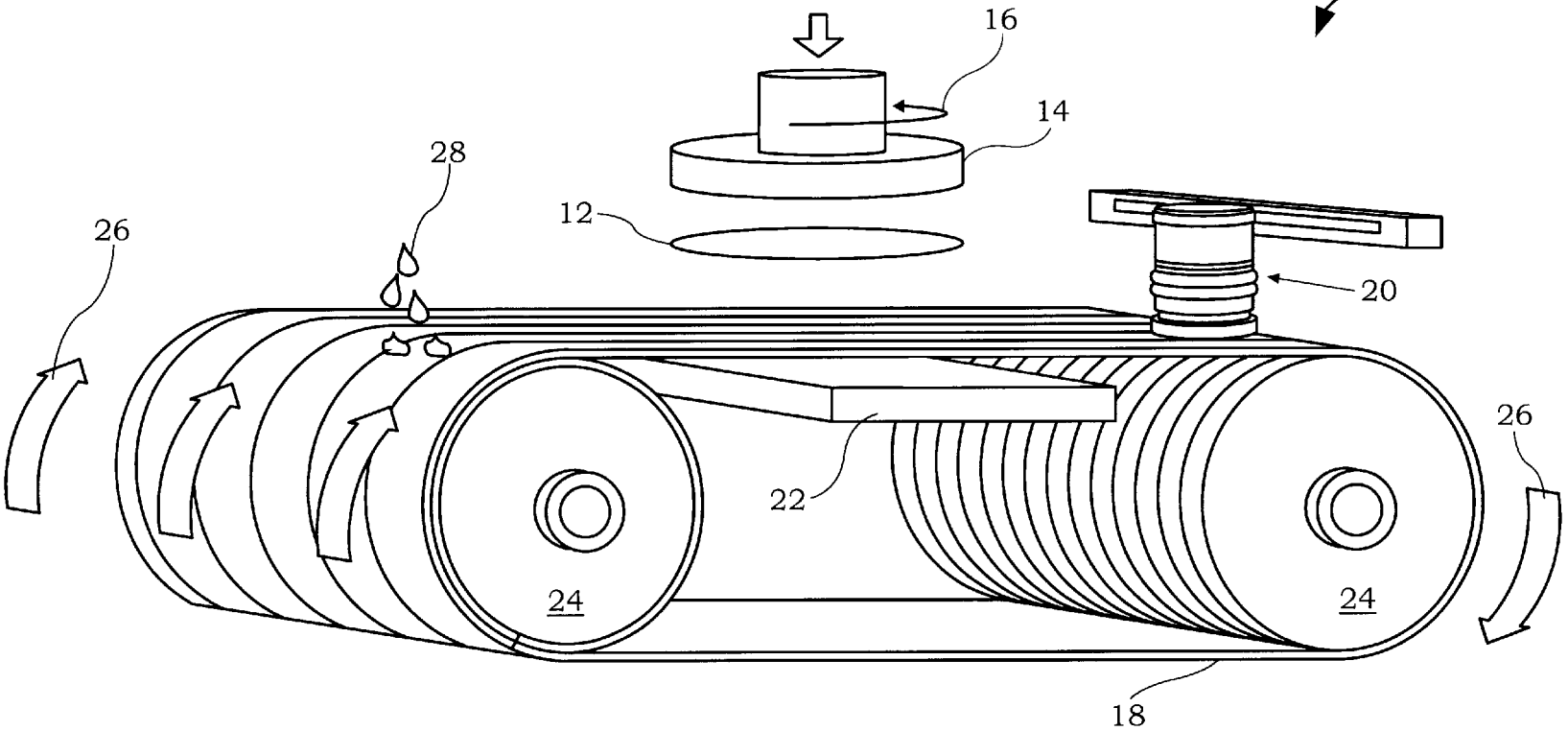
FIG. 1 (Prior Art)
FIG. 1 illustrates an exemplary prior art CMP system.
Figure 2:
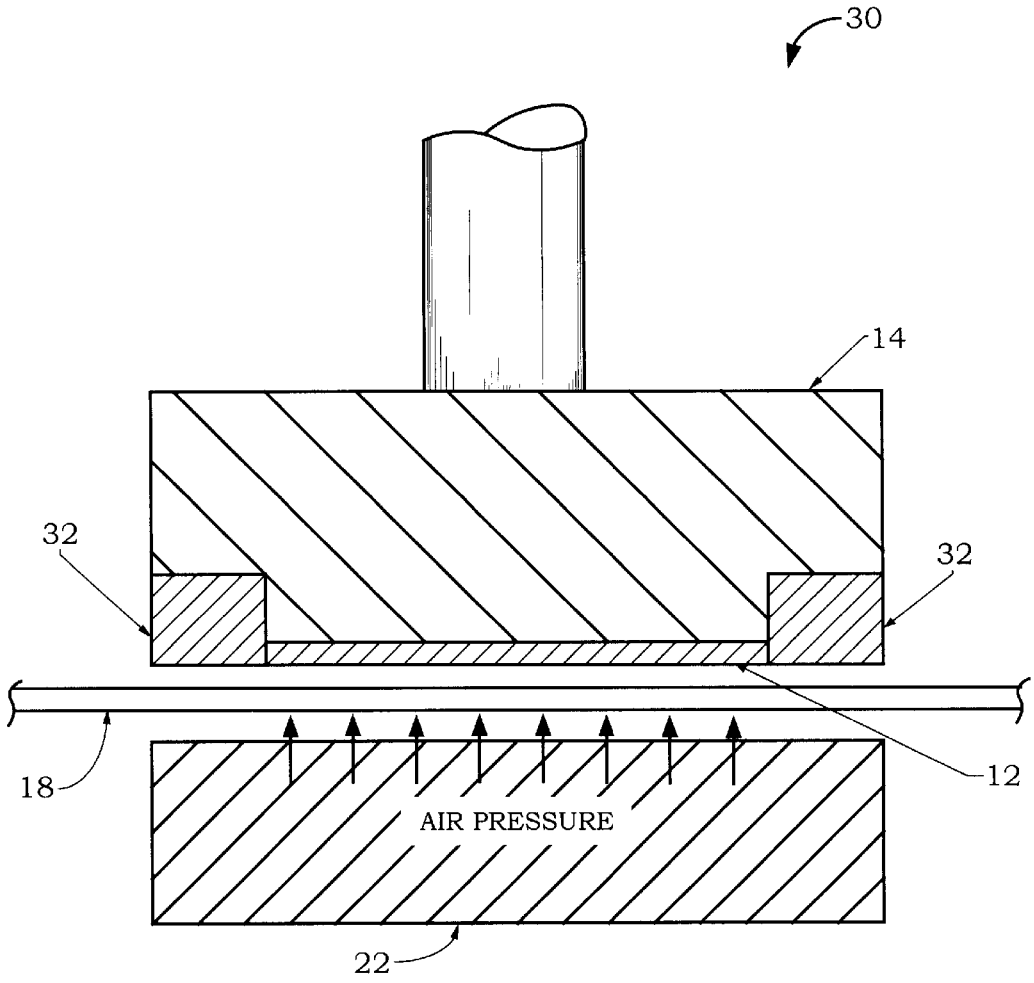
FIG. 2 (Prior Art)
FIG. 2 is a detailed view of a conventional wafer head and platen configuration.
Figure 3:
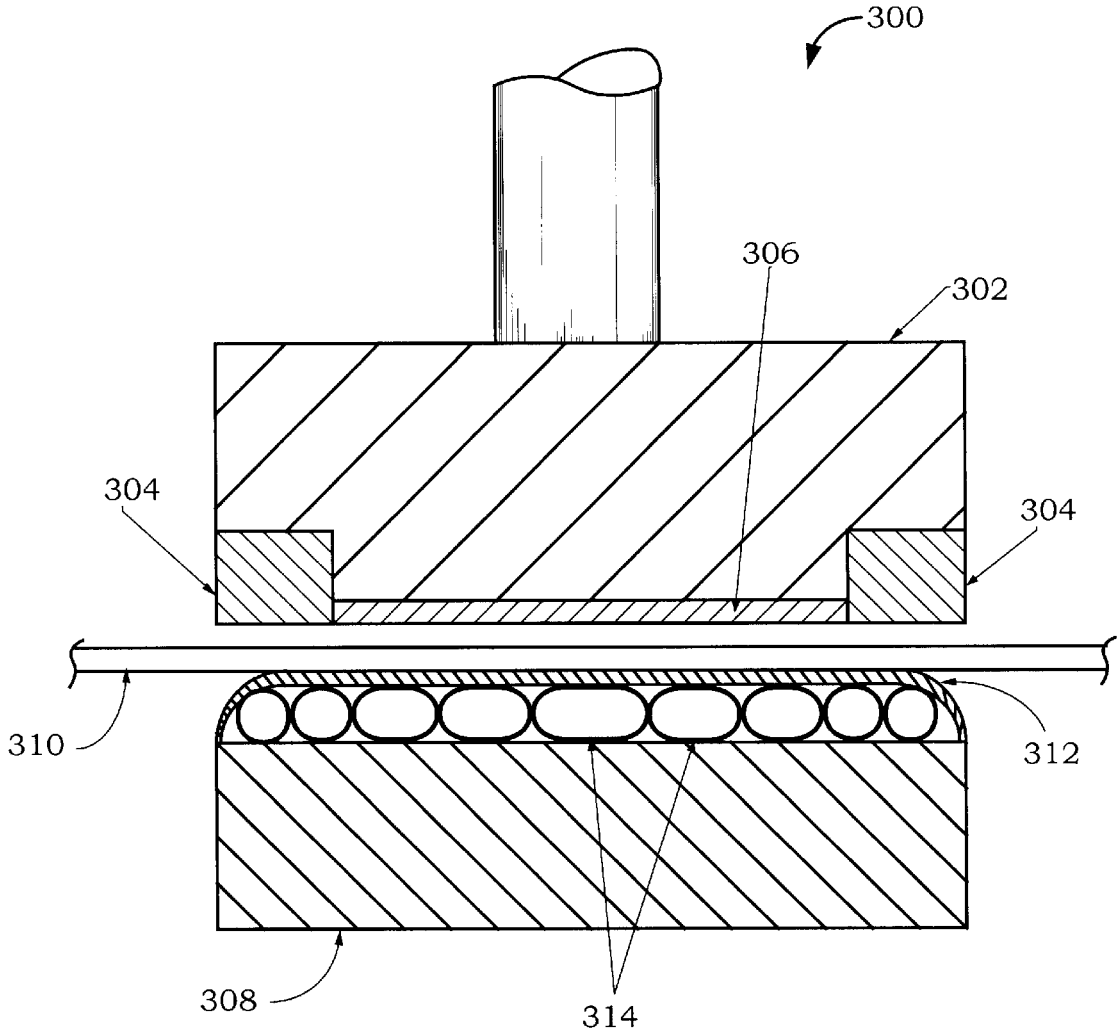
FIG. 3 is a diagram showing a platen configuration, in accordance with an embodiment of the present invention.

FIGS. 1–2 have been described in terms of the prior art. FIG. 3 is a diagram showing a platen configuration 300, in accordance with an embodiment of the present invention. The platen configuration 300 includes a wafer head 302 having a retaining ring 304 and a wafer 306 positioned below the wafer head 302. The platen configuration 300 also includes a platen 308 disposed below a polishing belt 310. The platen 308 includes a pressurized membrane 312 pressurized via annular bladders 314.

During operation the platen 308 is placed against the polishing pad or belt 310 that polishes the surface of the wafer 306. To promote polishing uniformity, each bladder 314 may be individually pressurized via an air source. Advantageously, the annular bladders 314 improve performance in the CMP process by providing increased zonal control to the pressurized membrane 312. Unlike a conventional air bearing, the pressurized membrane 312 of the embodiments of the present invention greatly reduces the amount of air needed during the CMP process.

Moreover, a CMP process using the pressurized membrane 312 of the present invention is not as sensitive to conditions as conventional CMP processes utilizing air bearings. Unlike air bearings, the pressure of the pressurized membrane 312 of the present invention does not experience as great a variance as experienced by air bearings when the gap between the polishing pad 310 and the platen 308 varies. Thus, if the polishing pad 310 is pushed toward the platen 308 in one area, the pressure in other areas of the pressurized membrane 312 are not as affected as other areas would be when utilizing an air bearing because the bladders are decoupled from each other.

Figure 4:
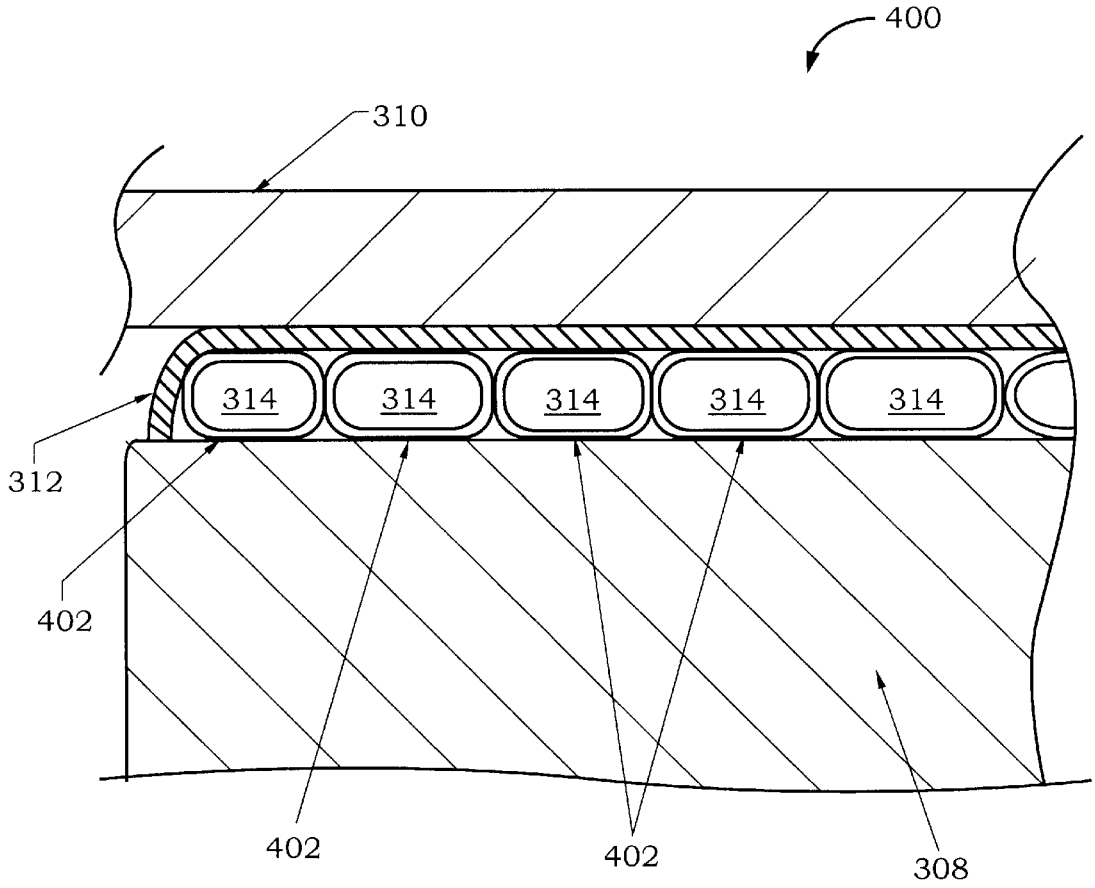
FIG. 4 is a detailed diagram showing a platen configuration, in accordance with an embodiment of the present invention.

FIG. 4 is a detailed diagram showing a platen configuration 400, in accordance with an embodiment of the present invention. The platen configuration 400 shows a polishing belt 310 positioned above a platen 308 having a pressurized membrane 312 pressurized by annular bladders 314. As shown in FIG. 4, each annular bladder 314 comprises a thin tubular material 402. In one embodiment, the tubular material 402 of each annular bladder 314 is pressurized via air. However, it should be noted that the tubular material 402 can be pressurized utilizing any other means capable of pressurizing an annular bladder 314, such as a fluid, as will be apparent to those skilled in the art.

The pressurized membrane 312 preferably comprises a smooth, flexible material. Suitable materials include; polyurethane, silicon, thin metals (e.g., stainless steel), poly (ether ether ketone) (PEEK), and Teflon. As previously mentioned, the annular bladders 314 provide increased zonal control during a CMP process. To further increase zonal control, the size of the annular bladders 314 within the pressurized membrane 312 can be varied, as described in greater detail subsequently.

Figure 5:
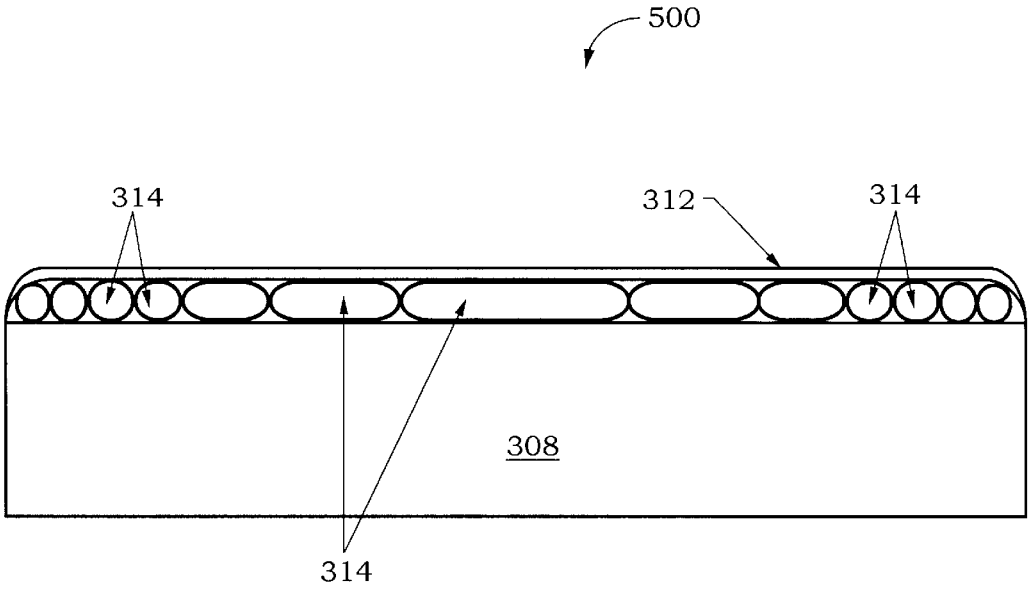
FIG. 5 is a diagram showing a platen configuration having varied annular bladders, in accordance with an embodiment of the present invention.

FIG. 5 is a diagram showing a platen configuration 500 having varied annular bladders, in accordance with an embodiment of the present invention. The platen configuration 500 includes a platen 308 having a pressurized membrane 312 pressurized via annular bladders 314. As shown in FIG. 5, the platen configuration 500 includes annular bladders 314 having varying sizes.

More specifically, the annular bladders 314 decrease in size as the annular bladders 314 approach the edge of the platen 308. Generally, during a CMP process, more difficulty occurs within about 10–15 mm of the wafer edge. For this reason, one embodiment of the present invention increases resolution near the wafer edge by decreasing the size of the annular bladders 314 near the edge of the platen 308. Similarly, since the center of the wafer typically requires less resolution, the central annular bladders 314 often are larger than those at the edge of the platen 308.

Figure 6A:
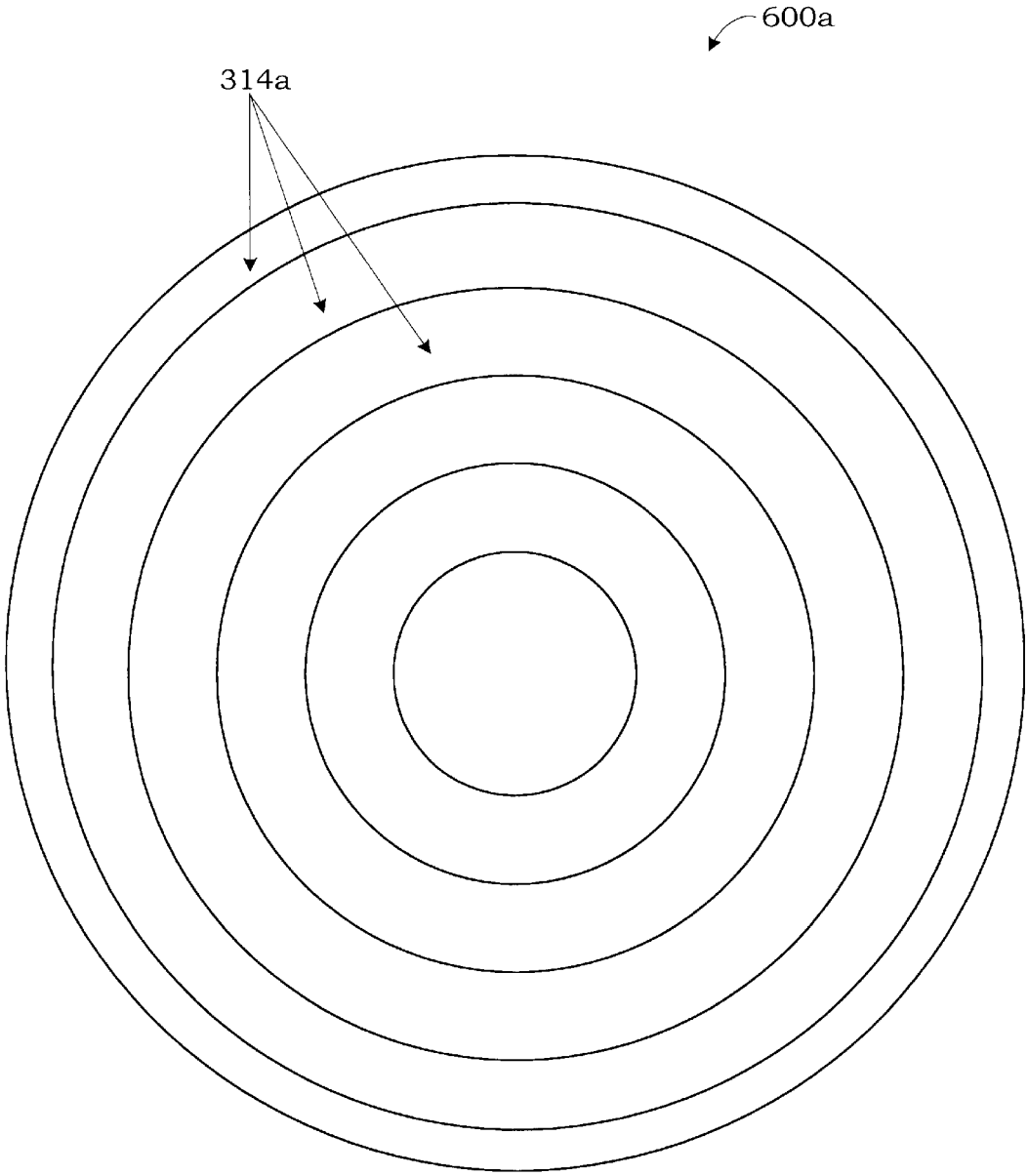
FIG. 6A is a top view of an annular bladder configuration, in accordance with an embodiment of the present invention.

FIG. 6A is a top view of an annular bladder configuration 600*a* in accordance with an embodiment of the present invention. The annular bladder configuration 600*a* includes concentric annular bladders 314*a*. In one embodiment, each concentric annular bladder 314*a* of the annular bladder configuration 600*a* forms a complete circle about the center of the platen. In this manner each annular bladder 314*a* can be individually pressurized to provide zonal control during the CMP process. To further increase zonal control during the CMP process, the length of each annular bladder can be reduced, as discussed next with reference to FIG. 6B.

Figure 6B:
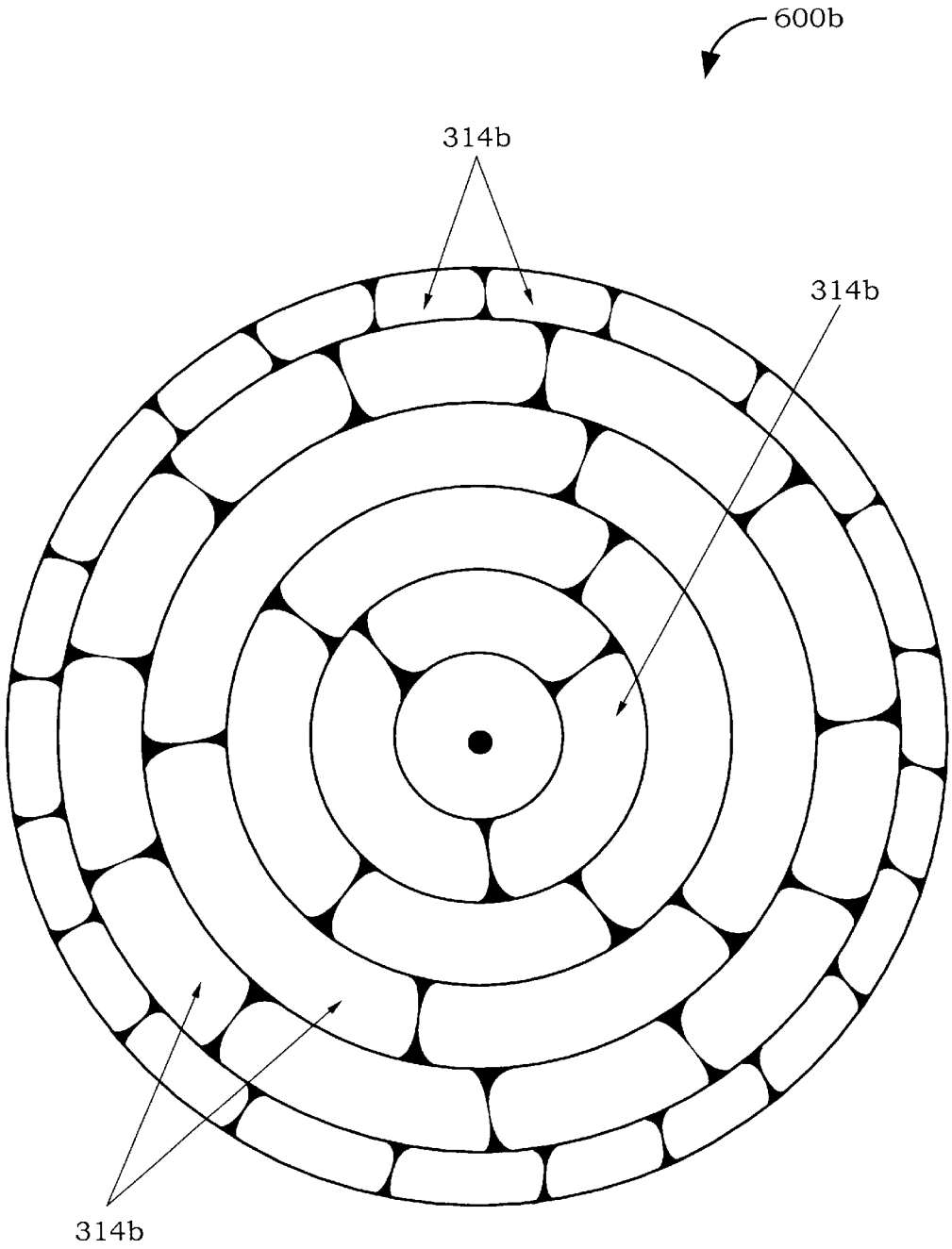
FIG. 6B is a top view showing an annular bladder configuration, in accordance with an embodiment of the present invention.

FIG. 6B is a top view showing an annular bladder configuration 600*b* in accordance with an embodiment of the present invention. The annular bladder configuration 600*b* includes concentric annular bladders 314*b*. Unlike the embodiment of FIG. 6A, each concentric annular bladder 314*b* of the annular bladder configuration 600*b* does not form a complete circle about the center of the platen. Each concentric annular bladder 314*b* of the annular bladder configuration 600*b* varies in size depending on a particular annular bladder's 314 proximity to the edge of the platen.

As mentioned above, during a CMP process, more difficulty generally occurs within about 10–15 mm of the wafer edge. For this reason, one embodiment of the present invention increases resolution near the wafer edge by decreasing the size of the annular bladders 314*b* near the edge of the platen. Similarly, since the center of the wafer typically requires less resolution, the central annular bladders 314*b* often are larger than those at the edge of the platen.

Advantageously, embodiments of the present invention improve performance in CMP applications by providing increased zonal control via a membrane pressurized using internal annular bladders. Other embodiments of the present invention also improve performance in CMP applications by providing increased zonal control via piezoelectric transducers.

Many polymers, ceramics, and molecules such as water are permanently polarized, having some parts of the molecule positively charged, while other parts of the molecule are negatively charged. When an electric field is applied to these materials, these polarized molecules align themselves with the electric field, resulting in induced dipoles within the molecular or crystal structure of the material. Furthermore, a permanently-polarized material such as quartz ($SiO_2$) or barium titanate ($BaTiO_3$) will produce an electric field when the material changes dimensions as a result of an imposed mechanical force. These materials are piezoelectric, and this phenomenon is known as the piezoelectric effect. Conversely, an applied electric field can cause a piezoelectric material to change dimensions. This phenomenon is known as electrostriction, or the reverse piezoelectric effect.

Figure 7:
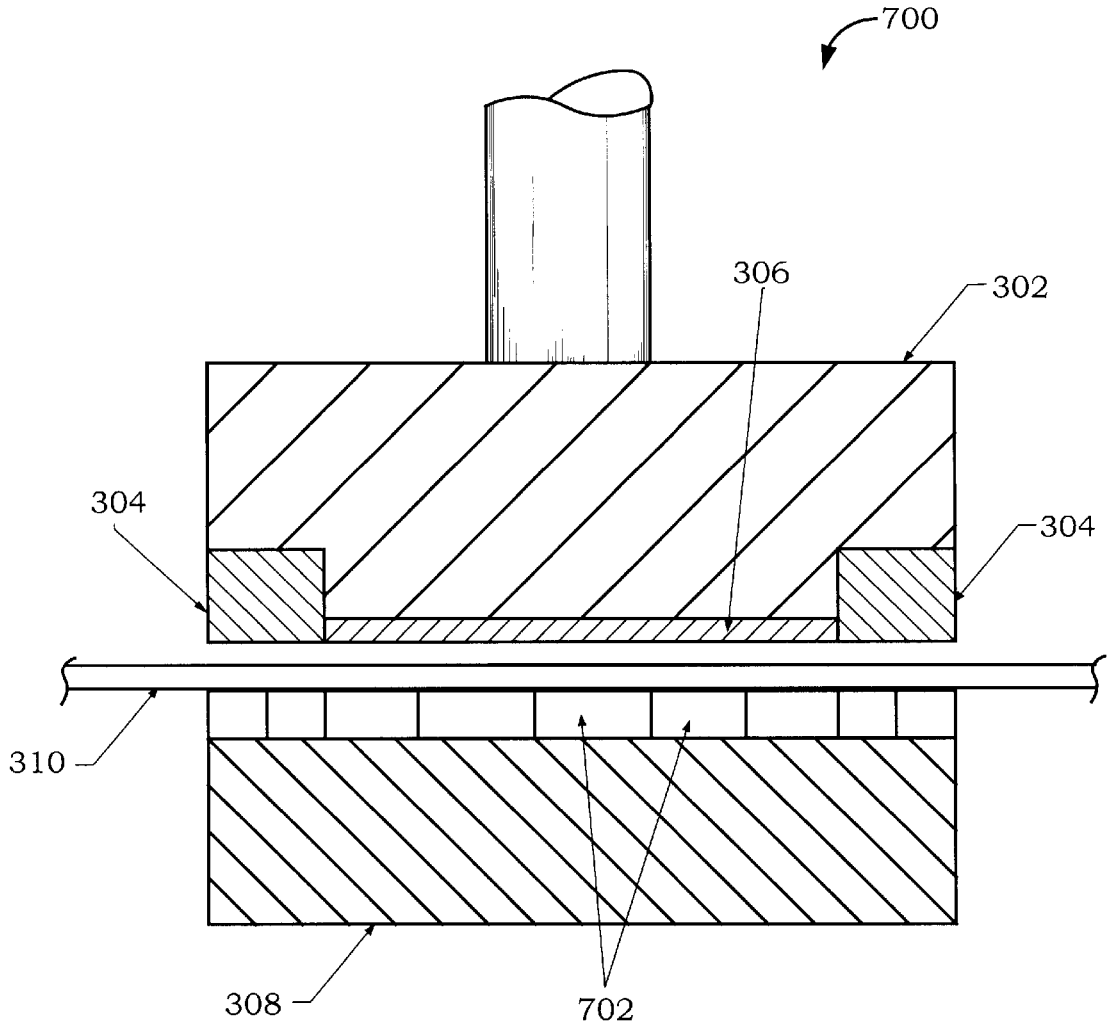
FIG. 7 is a diagram showing a platen configuration, in accordance with an embodiment of the present invention.

Hence, one embodiment of the present invention utilizes piezoelectric materials to provide zonal control during a CMP process. FIG. 7 is a diagram showing a platen configuration 700, in accordance with an embodiment of the present invention. The platen configuration 700 includes a wafer head 302 disposed above a wafer 306, and having a retaining ring 304. In addition, a platen 308 is positioned below the polishing belt 310.

The platen 308 of the platen configuration 700 includes a plurality of piezoelectric elements 702 disposed below the polishing belt 310. During operation, the platen 308 is placed against the polishing pad or belt 310 that polishes the surface of the wafer 306. To promote polishing uniformity, each piezoelectric element 702 may be individually activated to apply zonal force to the polishing pad. Advantageously, the piezoelectric elements 702 improve performance in the CMP process by providing increased zonal control to the polishing belt 310. Unlike a conventional air bearing, the piezoelectric elements 702 of the embodiments of the present invention greatly reduce the amount of air needed during the CMP process.

Moreover, as with the pressurized membrane, a CMP process using the piezoelectric elements 702 of the present invention is not as sensitive to conditions as conventional CMP processes utilizing air bearings. Unlike air bearings, the force exerted by the piezoelectric elements 702 of the present invention does not experience as great a variance as experienced by air bearings when the gap between the polishing pad 310 and the platen 308 varies. Thus, if the polishing pad 310 is pushed toward the platen 308 in one area, the force exerted on the polishing belt 310 by other piezoelectric elements 702 is not as affected as other areas would be when utilizing an air bearing.

Figure 8:
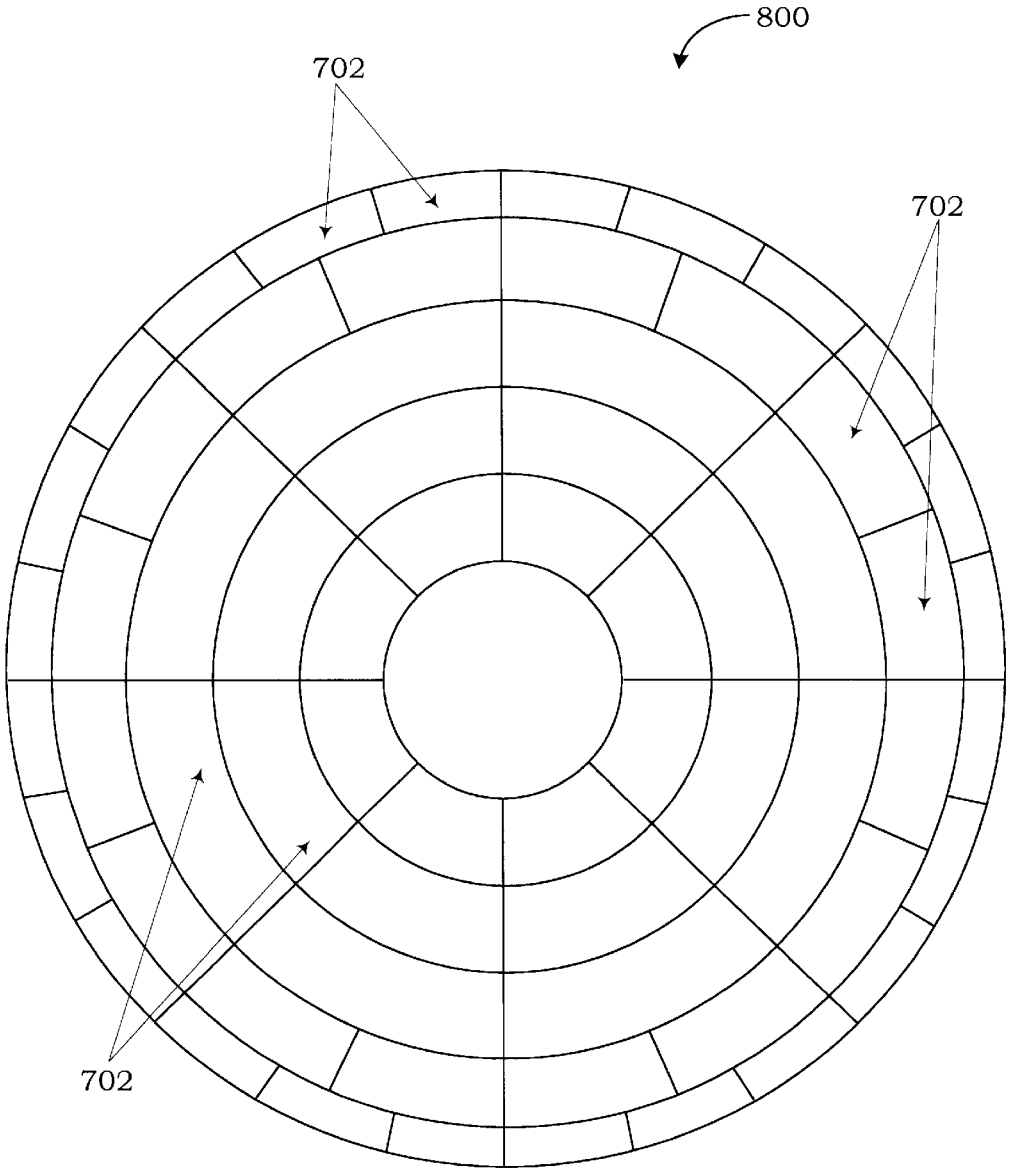
FIG. 8 is a top view of a piezoelectric element configuration, in accordance with an embodiment of the present invention.

FIG. 8 is a top view of a piezoelectric element configuration 800, in accordance with an embodiment of the present invention. The piezoelectric element configuration 800 includes concentric piezoelectric elements 702. Similar to the annular bladder configuration of FIG. 6A, in one embodiment of the present invention, each concentric piezoelectric element 702 forms a complete circle about the center of the platen. However, to further increase zonal control during the CMP process, the length of each piezoelectric element 702 can be reduced, as shown FIG. 8.

Unlike the embodiment of FIG. 6A, each concentric piezoelectric element 702 of the piezoelectric element configuration 800 does not form a complete circle about the center of the platen. Each concentric piezoelectric element 702 of the piezoelectric element configuration 800 varies in size depending on a particular piezoelectric element's 702 proximity to the edge of the platen.

As mentioned previously, during a CMP process, more difficulty generally occurs within about 10–15 mm of the wafer edge. For this reason, one embodiment of the present invention increases resolution near the wafer edge by decreasing the size of the piezoelectric elements 702 near the edge of the platen. Similarly, since the center of the wafer typically requires less resolution, the central piezoelectric elements 702 often are larger than those at the edge of the platen.

Unlike an air bearing, the embodiments of the present invention make physical contact with the polishing belt during the CMP process. As result, wear on the platen may be increased due to friction from the polishing belt. To provide additional protection from wear to the platen, a sacrificial material can be positioned between the platen and the polishing belt, as discussed next with reference to FIG. 9.

Figure 9:
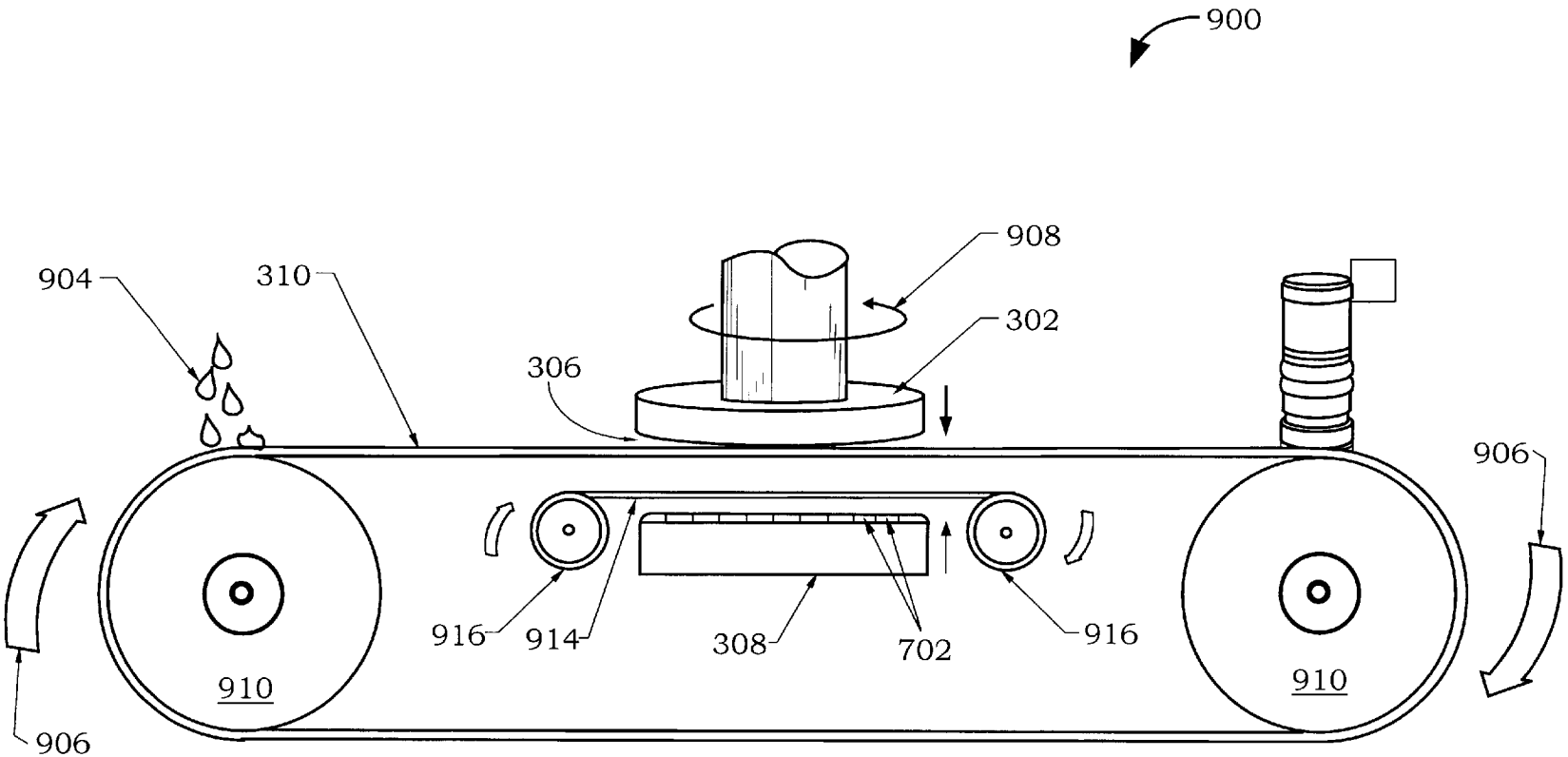
FIG. 9 is an illustration showing a CMP system, in accordance with an embodiment of the present invention.

FIG. 9 is an illustration showing a CMP system 900, in accordance with an embodiment of the present invention.

The CMP system 900 in FIG. 9 is a belt-type system having an endless polishing belt 310 mounted on two drums 910, which drive the polishing belt 310 in a rotational motion as indicated by belt rotation directional arrows 906. A wafer 306 is mounted on the wafer head 302, which is rotated in direction 908. The rotating wafer 306 is then applied against the rotating polishing belt 310 with a force F to accomplish a CMP process. Some CMP processes require significant force F to be applied.

A platen 308, having piezoelectric elements 702, is provided to stabilize the polishing belt 310 and to provide a solid surface onto which to apply the wafer 306. Slurry 904 composing of an aqueous solution such as $NH_4OH$ or DI containing dispersed abrasive particles is introduced upstream of the wafer 306. The process of scrubbing, buffing and polishing of the surface of the wafer is achieved by using an endless polishing pad glued to the polishing belt 310. Typically, the polishing pad is composed of porous or fibrous materials and lacks fix abrasives.

Disposed between platen 308 and the polishing belt 310 is a sacrificial material 914 fed roll-to-roll over the platen 308 via rollers 916. During use, the sacrificial material 914 is fed slowly over the platen 308 to provide protection from wear. In an alternative embodiment, the sacrificial material 914 is indexed as the CMP process progresses. In this manner, the sacrificial material 914 is worn, rather than the material of the platen 308. Hence, the piezoelectric elements 702 or the pressurized membrane are protected from wear caused by the friction of the rotating polishing belt 310.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A platen for improving performance in chemical mechanical polishing (CMP) applications, comprising:

a membrane disposed above the platen; and a plurality of annular bladders disposed below the membrane, wherein the plurality of annular bladders is capable of exerting force on the membrane.

2. A platen as recited in claim 1, wherein the membrane comprises a soft and flexible material.

3. A platen as recited in claim 2, wherein the membrane comprises polyurethane.

4. A platen as recited in claim 1, wherein the plurality of annular bladders comprises annular bladders of varying dimensions.

5. A platen as recited in claim 4, wherein annular bladders near an edge of the platen are smaller than annular bladders near the center of the platen.

6. A platen as recited in claim 1, wherein each annular bladder of the plurality of annular bladders can be individually pressurized to exert force against the membrane.

7. A platen as recited in claim 6, wherein each annular bladder is pressurized utilizing a gas.

8. A platen as recited in claim 6, wherein each annular bladder is pressurized utilizing a liquid.

9. A system for improving performance in chemical mechanical polishing (CMP) applications, comprising:

a wafer head capable of carrying a wafer;

a polishing belt disposed below the wafer head; and a platen having a membrane positioned below the polishing belt, the platen further including annular bladders disposed below the membrane, wherein the annular bladders are capable of exerting force on the membrane.

10. A system as recited in claim 9, wherein the membrane of the platen comprises as soft and flexible material.

11. A system as recited in claim 9, wherein the annular bladders are of varying dimensions.

12. A system as recited in claim 11, wherein annular bladders near an edge of the platen are smaller than annular bladders near the center of the platen.

13. A system as recited in claim 9, wherein each annular bladder can be individually pressurized to exert force against the membrane.

14. A system as recited in claim 13, wherein the force exerted against the membrane is transferred to the polishing belt to provide zonal control during a CMP process.

15. A system as recited in claim 13, wherein each annular bladder is pressurized utilizing a gas.

16. A system as recited in claim 13, wherein each annular bladder is pressurized utilizing a liquid.

17. A method for improving performance in chemical mechanical polishing (CMP) applications, comprising the operations of:

providing a platen having a membrane positioned above the platen, the platen further including annular bladders disposed below the membrane, wherein the annular bladders are capable of exerting force on the membrane;

applying a wafer to a polishing belt disposed above the platen; and stabilizing the polishing belt utilizing the platen, wherein the membrane applies specific forces to the polishing belt utilizing the annular bladders.

18. A method as recited in claim 17, further comprising the operation of pressurizing individual annular bladders to provide force to specific areas of the membrane.

19. A method as recited in claim 17, wherein the plurality of annular bladders comprises annular bladders of varying dimensions.

20. A method as recited in claim 19, wherein annular bladders near an edge of the platen are smaller than annular bladders near the center of the platen.

21. A platen for improving performance in chemical mechanical polishing (CMP) applications, comprising:

a membrane comprising a soft and flexible material attached to the platen, the membrane being disposed above the platen; and a plurality of annular bladders disposed below the membrane, wherein each annular bladder of the plurality of annular bladders can be individually pressurized to exert force against the membrane.

22. A platen as recited in claim 21, wherein the plurality of annular bladders comprises annular bladders of varying dimensions.

23. A platen as recited in claim 22, wherein annular bladders near an edge of the platen are smaller than annular bladders near the center of the platen.

24. A system for improving performance in chemical mechanical polishing (CMP) applications, comprising:

a wafer head capable of carrying a wafer;

a polishing belt disposed below the wafer head; and a platen having a membrane comprising a soft and flexible material attached to the platen, the platen being positioned below the polishing belt, the platen further including a plurality of annular bladders disposed below the membrane, wherein each annular bladder of the plurality of annular bladders can be individually pressurized to exert force against the membrane, wherein the force exerted against the membrane is transferred to the polishing belt to provide zonal control during a CMP process.

25. A system as recited in claim 24, wherein the plurality of annular bladders comprises annular bladders of varying dimensions.

26. A system as recited in claim 25, wherein annular bladders near an edge of the platen are smaller than annular bladders near the center of the platen.

27. A method for improving performance in chemical mechanical polishing (CMP) applications, comprising the operations of:

providing a platen having a membrane positioned above the platen, the platen further including annular bladders disposed below the membrane, wherein the annular bladders are capable of exerting force on the membrane;

applying a wafer to a polishing belt disposed above the platen;

stabilizing the polishing belt utilizing the platen, wherein the membrane applies specific forces to the polishing belt utilizing the annular bladders; and pressurizing individual annular bladders to provide force to specific areas of the membrane.

28. A method as recited in claim 27, wherein the annular bladders are of varying dimensions.

29. A method as recited in claim 28, wherein annular bladders near an edge of the platen are smaller than annular bladders near the center of the platen.

* * * * *